US011621132B2

(12) United States Patent
Tacla et al.

(10) Patent No.: US 11,621,132 B2
(45) Date of Patent: Apr. 4, 2023

(54) BEND WEB DESIGN FOR REED SWITCHES

(71) Applicant: Littelfuse, Inc., Chicago, IL (US)

(72) Inventors: Richard Malabanan Tacla, Batangas (PH); Jordanuff Cabilan, Inosluban (PH); Edwin Canido Aberin, Batangas (PH)

(73) Assignee: Littelfuse, Inc., Chicago, IL (US)

( * ) Notice: Subject to any disclaimer, the term of this patent is extended or adjusted under 35 U.S.C. 154(b) by 0 days.

(21) Appl. No.: 17/341,964

(22) Filed: Jun. 8, 2021

(65) Prior Publication Data

US 2022/0392720 A1 Dec. 8, 2022

(51) Int. Cl.

| | |
|---|---|
| ***H01H 1/66*** | (2006.01) |
| ***H01H 11/00*** | (2006.01) |
| ***H01H 36/00*** | (2006.01) |
| ***H01H 50/54*** | (2006.01) |
| ***H01H 51/28*** | (2006.01) |
| ***H01H 1/00*** | (2006.01) |
| ***H01H 1/02*** | (2006.01) |

(52) U.S. Cl.
CPC ..... *H01H 11/005* (2013.01); *H01H 1/0201* (2013.01); *H01H 1/66* (2013.01)

(58) Field of Classification Search
USPC ..... 335/151
See application file for complete search history.

(56) References Cited

U.S. PATENT DOCUMENTS 4,004,198 A * 1/1977 Cairo ..... H01H 50/021 361/210
4,129,765 A * 12/1978 Herklotz ..... H01H 1/0201 200/268
5,883,556 A * 3/1999 Shutes ..... H01H 1/66 335/154

* cited by examiner

*Primary Examiner* — Toan T Vu
*Assistant Examiner* — Xuan Ly
(74) *Attorney, Agent, or Firm* — KDB Firm PLLC

(57) ABSTRACT

A reed switch including a cylindrical enclosure with two ends, a first blade and a second blade is disclosed. The first blade has a first lead, a first web, and a first contact, and the first web is bent at a first angle as compared to the first lead. The second blade has a second lead, a second web, and a second contact, and the second web is bent at a second angle as compared to the second lead. The first contact is disposed adjacent to the second contact with a gap between them.

17 Claims, 9 Drawing Sheets

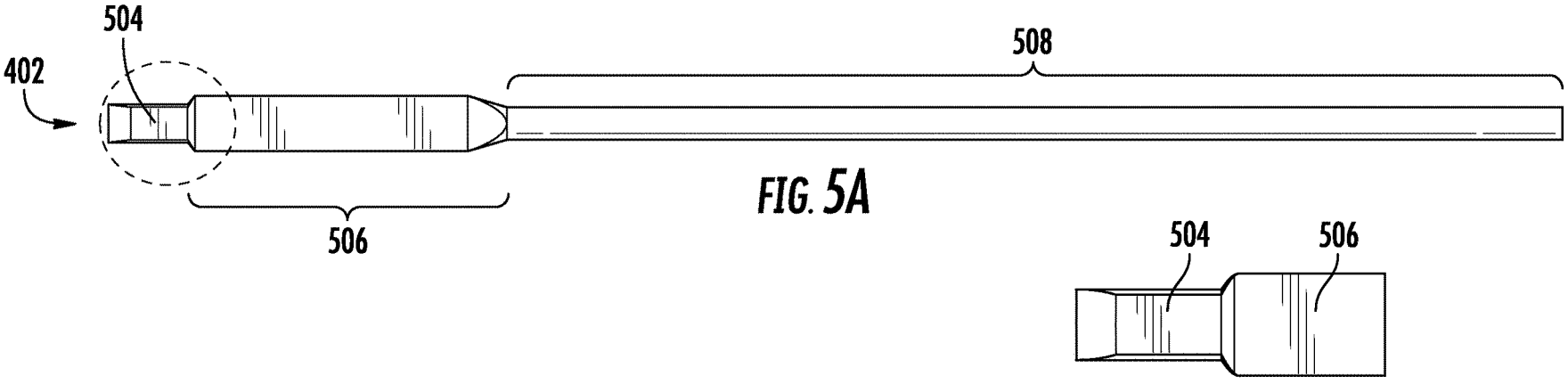
FIG. 5A
FIG. 5B
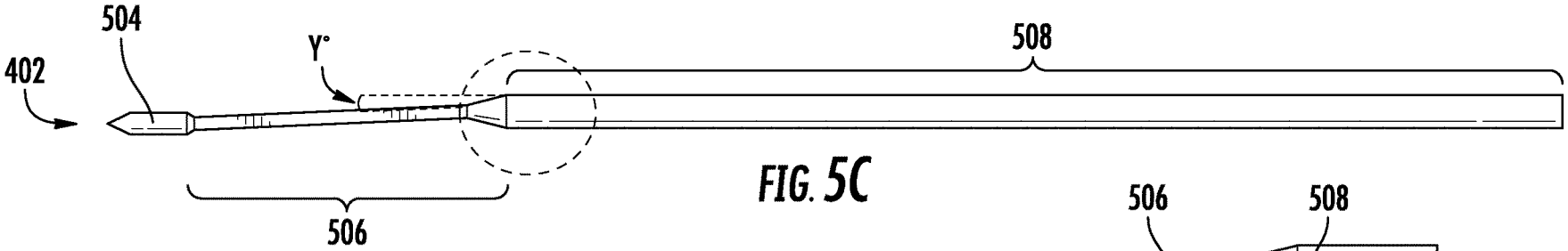
FIG. 5C
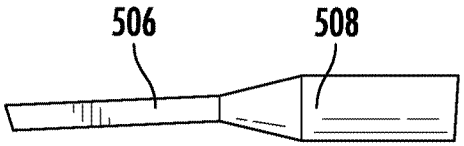
FIG. 5D

BEND WEB DESIGN FOR REED SWITCHES

FIELD OF THE DISCLOSURE

Embodiments of the present disclosure relate to reed switches and, more particularly, to reed switch manufacturing.

BACKGROUND

A reed switch is an electrical switch operated by an applied magnetic field. The reed switch has two ferromagnetic metal pieces, known as blades, portions of which are disposed in a hermetically sealed glass enclosure. Typically, the blades are not connected to one another, but become connected in the presence of the magnetic field. Alternatively, the blades may start out connected to one another, then separate when moved near a magnet.

The amount of magnetic field necessary to actuate the reed switch is known as its sensitivity or pull-in sensitivity, measured in ampere-turns (AT). Ampere-turns is given by the current in a test coil multiplied by the number of turns in the test coil. Although there is a limited range of metal alloys suitable for reed switches, that variation can still affect the pull-in sensitivity. The mechanical features of the blade, such as its length, width, thickness of the flexing (flat) part of the blade, and so on, can also affect pull-in sensitivity. In addition to the type, dimension, and shape of the blades, the distance between the tip portions of the blades, known as the contacts, affects the pull-in sensitivity of the reed switch.

The blades of the reed switch are typically relatively thin, with a wide portion at the contacts that makes the blades somewhat flexible. A portion of each blade is sealed in the glass enclosure so that the two contacts are a predefined distance apart so as to control the pull-in sensitivity of the reed switch. Reed switches may be quite small. Manufacturing the reed switch so that the contacts of the two blades are a precise distance apart can be challenging.

It is with respect to these and other considerations that the present improvements may be useful.

SUMMARY

This Summary is provided to introduce a selection of concepts in a simplified form that are further described below in the Detailed Description. This Summary is not intended to identify key or essential features of the claimed subject matter, nor is it intended as an aid in determining the scope of the claimed subject matter.

An exemplary embodiment of a reed switch in accordance with the present disclosure may include a cylindrical enclosure with two ends, a first blade and a second blade. The first blade has a first lead, a first web, and a first contact, and the first web is bent at a first angle as compared to the first lead. The second blade has a second lead, a second web, and a second contact, and the second web is bent at a second angle as compared to the second lead. The first contact is adjacent to the second contact with a gap between them.

Another exemplary embodiment of a reed switch in accordance with the present disclosure may include first and second blades. The first blade is to be inserted into a first end of a cylindrical enclosure and includes a first external portion and a first internal portion. The first external portion, which is outside the enclosure, includes a first part of a first lead. The first internal portion, which is inside the enclosure, includes a second part of the first lead, a first web, and a first contact. The first web is bent at a first angle relative to the first lead. The second blade is to be inserted into a second end of the cylindrical enclosure and includes a second external portion and a second internal portion. The second external portion includes a first part of a second lead. The second internal portion includes a second part of the second lead, a second web, and a second contact. The second contact is adjacent to and at a predetermined distance from the first contact. The second web is bent at a second angle relative to the second lead.

An exemplary embodiment of method of manufacturing a reed switch in accordance with the present disclosure may include inserting a first blade into a first end of a glass enclosure. The first blade has a first lead, a first web, and a first contact, with the first web being bent relative to the first lead. The first web and the first lead are inside the glass enclosure while the first lead crosses a threshold of the first end. The first end is heated up to seal the first blade in the first end and the first blade is orthogonal to the first end once the first end cools and hardens. A second blade is inserted into a second end of the glass enclosure. The second blade has a second lead, a second web, and a second contact, with the second web being bent relative to the second lead. The second contact is adjacent to the first contact with a gap between them. The second web and the second lead are inside the glass enclosure while the second lead crosses a second threshold of the second end. The second end is heated up to seal the second blade in the second end. The gap does not change once the second end cools and hardens.

BRIEF DESCRIPTION OF THE DRAWINGS

FIGS. 5A-5D are diagrams illustrating the blade of the reed switch of FIG. 4, in accordance with exemplary embodiments;

DETAILED DESCRIPTION

A novel reed switch is disclosed. The reed switch features three-part blades, where a web portion of each blade is disposed at an angle relative to the lead portion, the angle being adjustable. When the blades are sealed into the glass enclosure, a gap between adjacent contacts of each blade does not change once the glass seal is formed, ensuring that the pull-in sensitivity of the reed switch is reliable during manufacture.

Figure 1A:
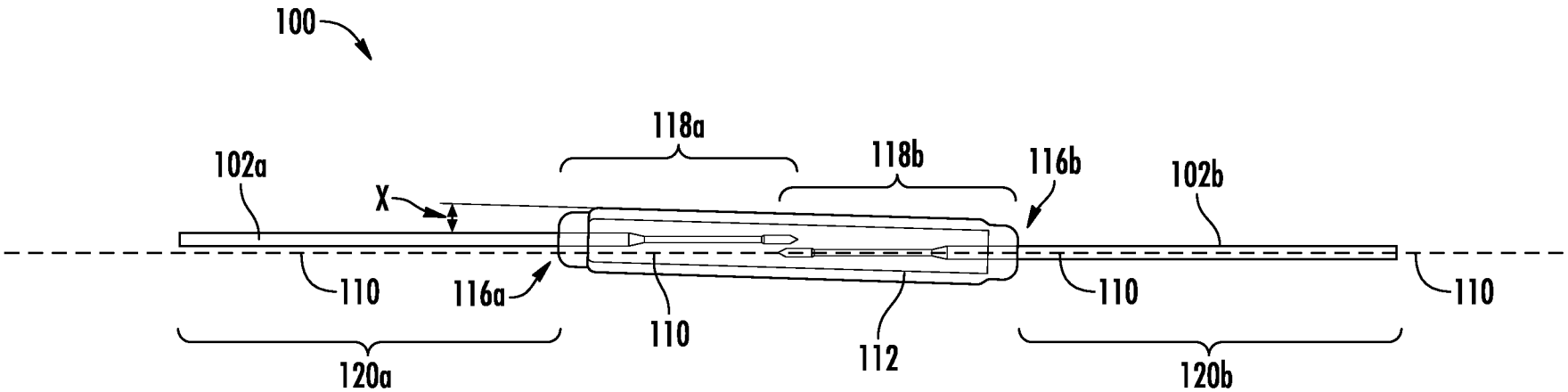
FIG. 1A (PRIOR ART)
FIGS. 1A-1D are diagrams illustrating a reed switch and its enclosure, according to the prior art.
Figure 1D:
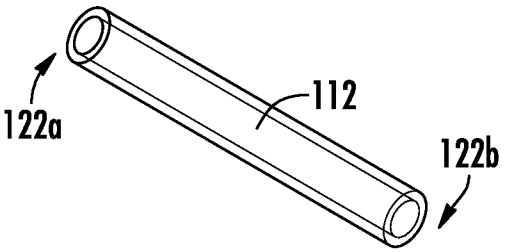
FIG. 1D (PRIOR ART)
Figure 1C:
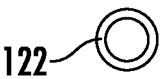
FIG. 1C (PRIOR ART)
Figure 1B:
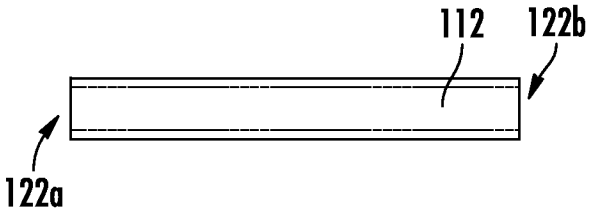
FIG. 1B (PRIOR ART)

FIGS. 1A-1D are representative drawings of a reed switch 100 and its enclosure, according to the prior art. FIG. 1A is a side view of the reed switch 100; FIG. 1B is a first side view of the reed switch enclosure orthogonal to the view of FIG. 1B; FIG. 1C is a second side view of the reed switch enclosure; and FIG. 1D is an isometric view of the reed switch enclosure. The reed switch 100 consists of a pair of blades 102*a* and 102*b* (collectively, "blades 102") which are partially inserted into an enclosure 112. Further details about the blades 102 of the prior art reed switch 100 are provided in the description of FIGS. 2A-2D and FIG. 3, below.

The enclosure 112 is a cylindrical tube made of glass that has been doped with small amounts of iron, making the glass a light green color. The enclosure includes two sealed ends, a sealed end 116*a* at one end of the cylindrical tube and a second sealed end 116*b* at the other end of the tube (collectively, "sealed ends 116"). FIGS. 1B-1D show the enclosure 112 in its raw glass form, before the formation of the sealed ends 116. Before becoming part of the reed switch 100, the enclosure 112 includes ends 122*a* and 122*b* (collectively, "ends 122"). Shown particularly in FIG. 1C, the ends 122 are substantially circular with a radius not much larger than the diameter of the fattest part of the blade 102. During assembly, the ends 122 are heated up, then cooled to harden and close around respective blades 102 to become sealed ends 116.

Named for their relationship to the enclosure 112, each blade 102 includes an inserted portion and an external portion. Thus, blade 102*a* includes inserted portion 118*a* and external portion 120*a* and blade 102*b* includes inserted portion 118*b* and external portion 120*b* (hereinafter, "inserted portions 118" and "external portions 120"). During manufacture, the inserted portion 118*a* of the blade 102*a* is fed into the end 122*a* while the external portion 120*a* remains outside the enclosure 112, with the end being heated into molten glass, which is thereafter sealed around the blade to form sealed end 116*a*. Next, the inserted portion 118*b* of the blade 102*b* is fed into the end 122*b* while the external portion 120*b* remains outside the enclosure 112, with the end also being heated into molten glass, which is thereafter sealed around the blade to form sealed end 116*b*. Once these operations are completed, the inserted portions 118 of the two blades are hermetically sealed, such that air, oxygen, and other gases are unable to enter the chamber of the enclosure 112. The external portion 120 of each blade 102 remains on the outside of the enclosure 112 for connecting the reed switch 100 to a circuit.

Figure 2A:
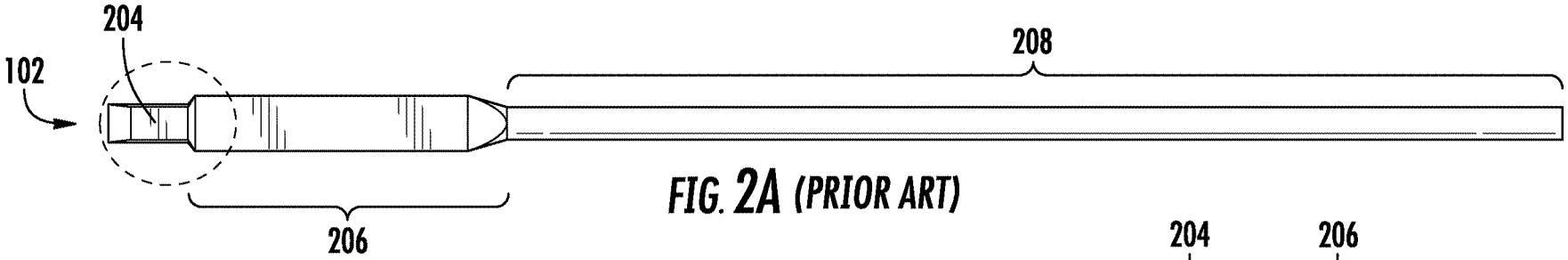
FIG. 2A (PRIOR ART)
FIGS. 2A-2D are diagrams illustrating the blade of a reed switch, according to the prior art.
Figure 2B:
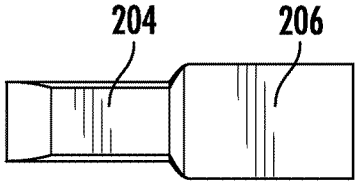
FIG. 2B (PRIOR ART)
Figure 2C:
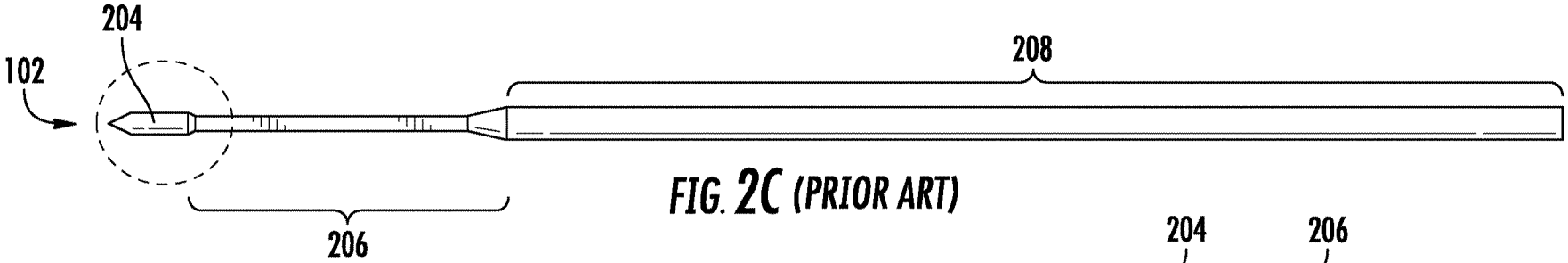
FIG. 2C (PRIOR ART)
Figure 2D:
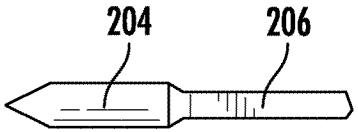
FIG. 2D (PRIOR ART)
Figure 3:
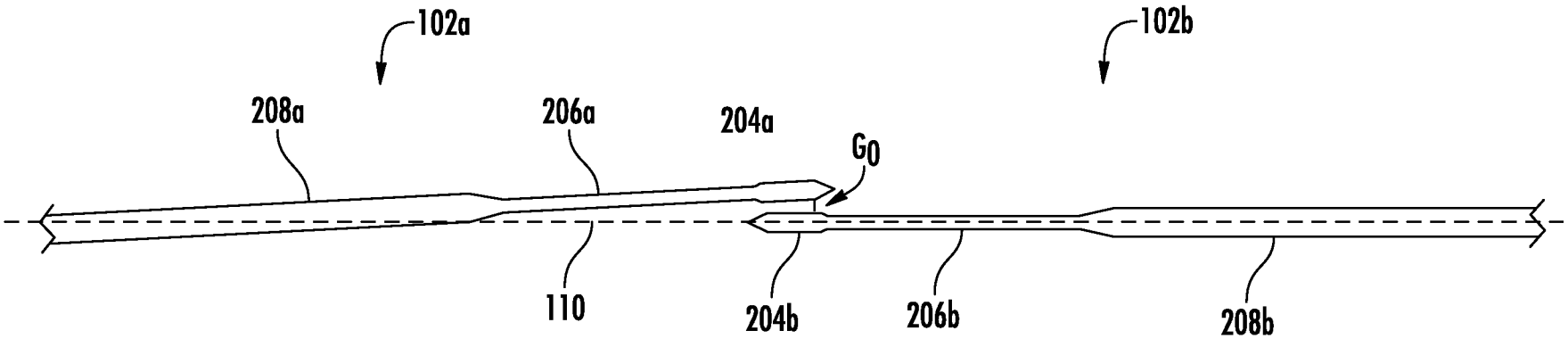
FIG. 3 (PRIOR ART)
FIG. 3 is a diagram illustrating a pairing of blades for the reed switch of FIG. 1A, according to the prior art.

FIGS. 2A-2D are representative drawings of the blade 102 of the reed switch 100 of FIG. 1A, according to the prior art. The blade 102 is a unitary ferromagnetic metal element consisting of a contact 204, a web 206, and a lead 208. FIG. 2A is a top view of the blade 102;

FIG. 2B is a close-up top view of the contact 204 of the blade 102; FIG. 2C is a side view of the blade 102; and FIG. 2D is a close-up side view of the contact 204 of the blade 102. The blade 102 features two transitions, where the characteristics of the blade components change. One transition is between the lead 208 and the web 206, and the other transition is between the web 206 and the contact 204.

The lead 208 is a cylindrical shape and thus looks similar when viewed from the top (FIG. 2A) or from the side (FIG. 2C). In one transition, from the top view, the web 206 is wider than the lead 208, whereas, in the side view, the web 206 is thinner and flatter than the lead 208. In a second transition, from the top view, the contact 204 is thinner and narrower than the web 206, whereas, in the side view, the contact 204 is thicker than the web 206. In the top view, the contact 204 resembles a flat-head screwdriver. In the side view, the contact 204 resembles a small pencil having a sharpened tip at the end distal to the lead 208.

The pull-in sensitivity of the reed switch 100 is proportional to the gap, or distance, between the two blades 102, specifically, the gap between the two contacts 204 inside the enclosure 112. The position of blade 102*a* relative to blade 102*b* thus governs how wide the gap is. A line 110 (FIG. 1A) provides a reference to illustrate the relative positions of blades 102*a* and 102*b* once they are sealed in the enclosure 112, as well as the orientation of the enclosure. Although blade 102*b* is disposed along the line 110, the blade 102*a* is not. Instead, the blade 102*a* is disposed above the line 110. Further, the top of the enclosure 112 is offset from the blade 102*a* by some degree, given by X.

The degree offset, X, is not intentional. During manufacture of the reed switch 100, each blade 102 is positioned to be disposed along the line 110. Further, the enclosure 112 is also disposed along the line 110 such that the line bisects the sealed ends 116, with the top and bottom of the cylindrical enclosure being parallel to the line. In the example of FIG. 1A, the blade 102*a* is inserted into the end 122*a* of the enclosure 112 and disposed along the line 110. Similarly, the blade 102*b* is inserted into the end 122*b* of the enclosure 112 and disposed along the line 110. At this point, the contact 204*a* of blade 102*a* is touching the contact 204*b* of blade 102*b*, with both blades being positioned inside the not yet sealed glass enclosure 112. The first sealing operation is performed by heating up the end 122*a* and allowing the heated glass to cool and harden, thus securing the blade 102*a*; then the second sealing operation is performed by heating up the end 122*b* and allowing the heated glass to cool and harden, thus securing the blade 102*b*. While the glass is still soft/molten, the gap, or distance, between the contacts 204 is set mechanically. After the ends 122 cool down (and become sealed ends 116), the blades are secured. However, the mechanically set gap moves during the cooling operation and one of the blades, blade 102*a*, in this example, is no longer at its intended location along the line 110.

Recall that the blades 102 are to be hermetically sealed to the enclosure 112. This is achieved by melting the ends 122 of the glass enclosure 112, such as by using high-energy infrared beams. Upon cooling and hardening of the molten glass, the ends 122 will become sealed ends 116 which will mechanically secure the blades 102. The degree offset, X, is thus caused during the operation to secure the blades 102 to respective sealed ends 116 of the enclosure 112. During the cooling and hardening stage, the two blades are "thrown" toward the center of the enclosure 112. This phenomenon is influenced by the cohesive property of glass as well as gravity. Gravity will pull the molten glass toward the center of gravity of the assembly, thus affecting the initial position of the blades 102 after the gap is established. Cohesion or molecular retraction of glass during the transition between molten state to solid state of glass also affects the initial position of the blades 102. Thus, while the blades 102 may be positioned in their intended locations in the enclosure 112, once the molten material sealing the ends cools, one (or both) blades shift away from the original disposition.

In FIG. 1A, the enclosure 112 obscures the view of the blades 102, particularly the contacts 204. Thus, a new view of the blades 102 is presented in FIG. 3, according to the prior art. Blade 102*a* features contact 204*a*, web 206*a*, and lead 208*a*; blade 102*b* features contact 204*b*, web 206*b*, and lead 208*b*. The blade 102*b* is disposed along the line 110 while the blade 102*a* is not. A gap, $G_0$, is formed between the contact 204*a* and the contact 204*b* as the distance between the two contacts. Because the position of the blade 102*a* has changed relative to its original placement, the intended placement of the two contacts 204 changes. This means that the gap, $G_0$, between the two contacts 204 varies.

As a result of the change in the dimension of the gap, $G_0$, the pull-in sensitivity of the reed switch 100 varies from the original design.

Thus, the reed switch 100 has low capability in terms of targeting a preferred pull-in sensitivity (AT) set during assembly. Failing to meet targets during manufacturing of the reed switch is likely to cause difficulty in adhering to customer demands (time and volume). Further, some of the inventory may have a pull-in sensitivity that is too high or too low, resulting in inventory that is discarded. If additional capacity is created to overcome the high scrap hit, this increases costs for the manufacturer.

Figure 4:
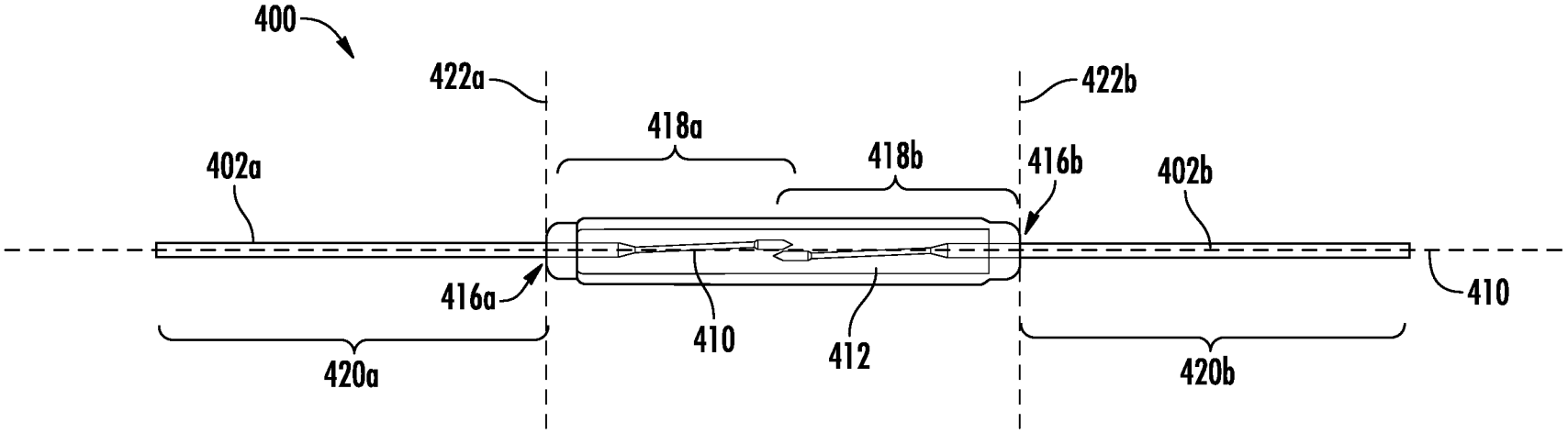
FIG. 4 is a diagram illustrating a reed switch, in accordance with exemplary embodiments.

FIG. 4 is a representative drawing illustrating a novel reed switch 400, according to exemplary embodiments. The reed switch 400 consists of a pair of blades 402*a* and 402*b* (collectively, "blades 402") which are partially inserted into an enclosure 412. Further details about the blades 402 of the novel reed switch 400 are provided in the description of FIGS. 5A-5D and FIG. 6, below.

The enclosure 412 is a cylindrical tube made of glass that has been doped with small amounts of iron, making the glass a light green color. In exemplary embodiments, the enclosure 412 is substantially similar to the enclosure 112 of FIGS. 1B-1D. Thus, the enclosure includes two ends, an end 122*a* at one end of the cylindrical tube and an end 122*b* at the other end of the tube (e.g., ends 122). The ends 122 are substantially circular with a radius not much larger than the diameter of the fattest part of the blade 402. As described in more detail, below, upon receipt of respective blades 402, the ends 122 are heated into molten material and harden into sealed ends 416*a* and 416*b* for securing the blades (collectively, "sealed ends 416").

Named for their relationship to the enclosure 412, each blade includes an inserted portion and an external portion. Thus, blade 402*a* includes inserted portion 418*a* and external portion 420*a* and blade 402*b* includes inserted portion 418*b* and external portion 420*b* (hereinafter, "inserted portions 418" and "external portions 420"). During manufacture, the inserted portion 418*a* of the blade 402*a* is fed into an end (e.g., end 122*a* in FIG. 1D) while the external portion 420*a* remains outside the enclosure 412, with the end being melted into molten glass due to application of heat, such as high-energy infrared beams, and, upon hardening of the molten glass, being sealed around the blade. Next, the inserted portion 418*b* of the blade 402*b* is fed into a second end (e.g., end 122*b* in FIG. 1D) while the external portion 420*b* remains outside the enclosure 412, with the end being melted into molten glass due to application of heat and, upon hardening of the molten glass, being sealed around the blade. Upon the sealing of the blade 402*b*, the inserted portions 418 of the two blades are hermetically sealed, such that air, oxygen, and other gases are unable to enter the chamber of the enclosure 412. The external portion 420 of each blade 402 remains on the outside of the enclosure 412 for connecting the reed switch 400 to a circuit.

A line 410 provides a reference to illustrate the relative positions of blades 402*a* and 402*b* once they are sealed in the enclosure 412, as well as the orientation of the enclosure. In contrast to the prior art reed switch 100 (FIG. 1A), both blades 402 of the novel reed switch 400 are disposed along the line 410. Further, in exemplary embodiments, the enclosure 412 is substantially parallel to the line 410. There does not appear to be an offset between the position of the top of the enclosure 412 and the line 410, as there is in the prior art reed switch 100. In exemplary embodiments, the orientation of the blades 402 and the enclosure 412 along the line 410 results from a novel configuration of the blades 402.

FIGS. 5A-5D are representative drawings of the blade 402 of the reed switch 400 of FIG. 4, according to exemplary embodiments. The blade 402 is a unitary ferromagnetic metal element consisting of a contact 504, a web 506, and a lead 508. FIG. 5A is a top view of the blade 402; FIG. 5B is a close-up top view of the contact 504 of the blade 402; FIG. 5C is a side view of the blade 402; and FIG. 5D is a close-up side view of the contact 504 of the blade 402. The blade 402 features two transitions, where the characteristics of the blade components change. One transition is between the lead 508 and the web 506, and the other transition is between the web 506 and the contact 504.

The lead 508 is a cylindrical shape and thus looks similar when viewed from the top (FIG. 5A) or from the side (FIG. 5C). In one transition, from the top view, the web 506 is wider than the lead 508, whereas, in the side view, the web 506 is thinner and flatter than the lead 508. In a second transition, from the top view, the contact 504 is thinner and narrower than the web 506, whereas, in the side view, the contact 504 is thicker than the web 506. In the top view, the contact 504 resembles a flat-head screwdriver. In the side view, the contact 504 resembles a small pencil having a sharpened tip at the end distal to the lead 508. In exemplary embodiments, the contact 504 and the web 506 are in the same plane.

The top and top closeup views of the blade 402 (FIGS. 5A and 5B) look substantially similar to the top and top closeup views of the blade 102 (FIGS. 2A and 2B). However, the side and side closeup views of the blade 402 (FIGS. 5C and 5D) show how the blade 402 is different from the blade 102 (FIGS. 2C and 2D). In exemplary embodiments, the web 506 of the blade 402 is bent relative to the lead 508. In exemplary embodiments, the web 506 is offset by an angle of Y° relative to the lead 508, with the Y° angle being proportional to the pull-in sensitivity of the reed switch 400. Because the web 506 and the contact 504 are in the same plane, the contact 504 is also offset by an angle of Y° relative to the lead 508, in some embodiments. The novel reed switch 400 may thus be thought of as a "bend web" design. In exemplary embodiments, the angle, Y, is adjustable. Thus, the offset angle of the web 506 relative to the lead 508 may be large or small, depending on the desired pull-in sensitivity of the reed switch 400.

As with other reed switches, the pull-in sensitivity of the bend web reed switch 400 is proportional to the gap between the two blades 402, specifically, the gap between the two contacts 404 inside the enclosure 412. The position of blade 402*a* relative to blade 402*b* thus governs the width of the gap. In exemplary embodiments, the Y° angle between the web 506 and the lead 508 of the blade 402 enables the gap between two contacts 404 inside the enclosure 412 of the novel reed switch 400 to be controlled.

In FIG. 4, the enclosure 412 obscures the view of the blades 402, particularly the contacts 504. Thus, a new view of the blades 402 is presented in FIG. 6, according to exemplary embodiments. Blade 402*a* features contact 504*a*, web 506*a*, and lead 508*a*; blade 402*b* features contact 504*b*, web 506*b*, and lead 508*b*. Both blades 402*a* and 402*b* are disposed along the line 510. As illustrated in FIG. 5C, the blade 402 has a web 506 that is offset by Y degrees from the lead 508. For the coupled reed switch blades in FIG. 6, the web 506*a* of blade 402*a* is offset by $Y_1$° from the lead 508*a* and the web 506*b* of blade 402*b* is offset by $Y_2$° from the lead 508*b*. In exemplary embodiments, the offsets $Y_1$ and $Y_2$ are substantially similar. A gap, $G_1$, is formed between the contact 504*a* and the contact 504*b*. In exemplary embodiments, the gap, $G_1$, is controlled by setting the offsets, $Y_1$ and $Y_2$.

Figure 6:
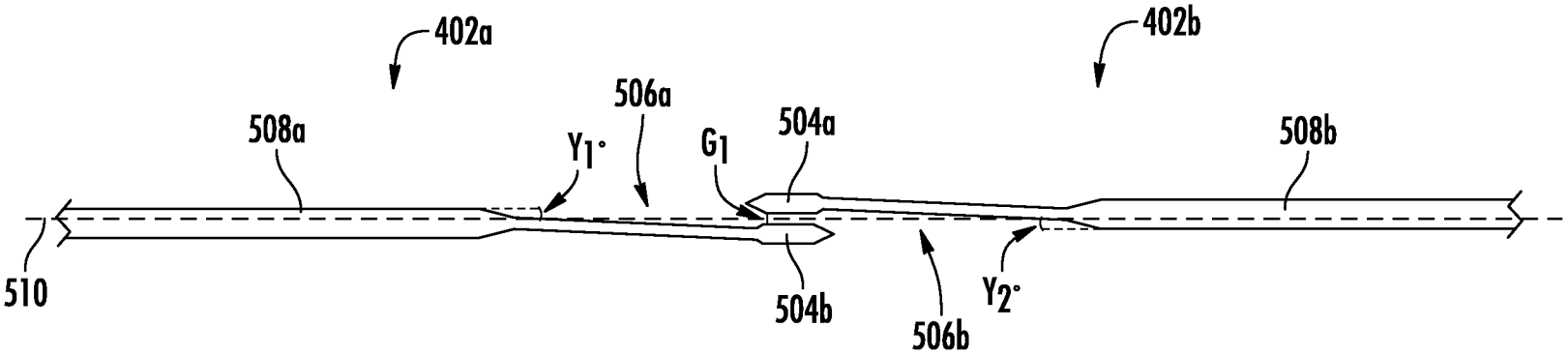
FIG. 6 is a diagram illustrating a pairing of blades for the reed switch of FIG. 4, in accordance with exemplary embodiments.

In exemplary embodiments, the blade 402*b* can be made from the blade 402*a* by flipping the blade 402*a* vertically, then horizontally, then moving the two contacts 504*a* and 504*b* until they are adjacent to one another. Or the blade 402*b* can be flipped horizontally, then vertically, before placing the contacts adjacent to one another. In the view of FIG. 6, the web 506*a* of blade 402*a* is bent downward relative to lead 508*a* and line 510, at angle, Yr. The web 506*b* of the blade 402*b* is bent upward relative to the lead 508*b* and line 510, at angle, $Y_2$. In exemplary embodiments, the lead 508*a* is in a plane and the lead 508*b* is in the same plane. In exemplary embodiments, the reed switch 400 is non-polarized and the blades 402*a* and 402*b* are interchangeable.

With reference to FIGS. 4 and 5C, the blades 402 of the bend web reed switch 400 are separately inserted into the enclosure 412, as with the blades 102 of the prior art reed switch 100. The external portion 420*a* of blade 402*a* consists of the lead 508*a*, while the inserted portion 418*a* consists of part of the lead 508*a*, as well as the web 506*a* and the contact 504*a*. Similarly, the external portion 420*b* of blade 402*b* consists of the lead 508*b*, while the inserted portion 418*b* consists of part of the lead 508*b*, as well as the web 506*b* and the contact 504*b*. The leads 508 cross the threshold of the respective ends of the enclosure 412. Thus, only the lead 508 of respective blades 402 are disposed at the thresholds (sealed ends 416) of the enclosure 412 once the molten glass material hardens.

Each blade 402 is positioned to be disposed along the line 410. In exemplary embodiments, the leads 508 are inserted into respective ends of the enclosure 412 such that the leads are orthogonal to the sealed ends 416 once the enclosure is sealed. Line 422*a* denotes the plane of sealed end 416*a* and line 422*b* denotes the plane of sealed end 416*b* (collectively, "lines 422"). In exemplary embodiments, upon insertion into the enclosure 412, leads 508 of the blades 402 are orthogonal to the lines 422. Further, by having the leads 508 centered in the sealed ends 416, a more rounded seal is created, for an improved visual appearance of the reed switch 400, in some embodiments.

Recall that the blades 402 are to be hermetically sealed to the enclosure 412. This is achieved by heating up the glass material of each side of the enclosure, until the material is molten glass. In contrast to the blades 102 of the prior art reed switch 100, once the molten glass cools and hardens around the blades 402 at respective sealed ends 416, neither of the blades 402 shift from the original disposition within the enclosure 412.

In exemplary embodiments, the enclosure 412 is also disposed along the line 410 such that the line bisects the sealed ends 416, with the top and bottom of the cylindrical enclosure being parallel to the line. Thus, the blade 402*a* is inserted into the end of the enclosure 412 and disposed along the line 410 once the end becomes the sealed end 416*a*. Next, the blade 402*b* is inserted into the end of the enclosure 412 and disposed along the line 410 once the end becomes the sealed end 416*b*.

In exemplary embodiments, the offset angles, $Y_1$ and $Y_2$, between the disposition of the leads 508 and the webs 506 of respective blades 402 enable both leads to be affixed to the enclosure 412 such that both leads line up with line 410 (and are orthogonal to lines 422). Further, both leads 508 remain lined up with line 410 following the hardening operation, in which the ends 416 become the sealed ends 416. The reed switch 400 is still affected by gravity, which pulls the molten glass toward the center of gravity of the assembly, and cohesion or molecular retraction, which affects the enclosure during the transition between molten state and solid state. Nevertheless, in exemplary embodiments, the bend web design results in the blades 402 no longer being thrown back towards the middle of the enclosure 412 during the hardening step, as occurs with the blades 102 of the prior art reed switch 100.

Because the position of each blade 402 (whether inserted into the enclosure 412 first or second) has not changed relative to their original placements, the gap, $G_1$, between the two contacts 504 is controllable and does not vary during manufacture. Because the dimension of the gap, $G_1$, does not vary, the pull-in sensitivity of the reed switch 400 is maintained, in exemplary embodiments.

Figure 7:
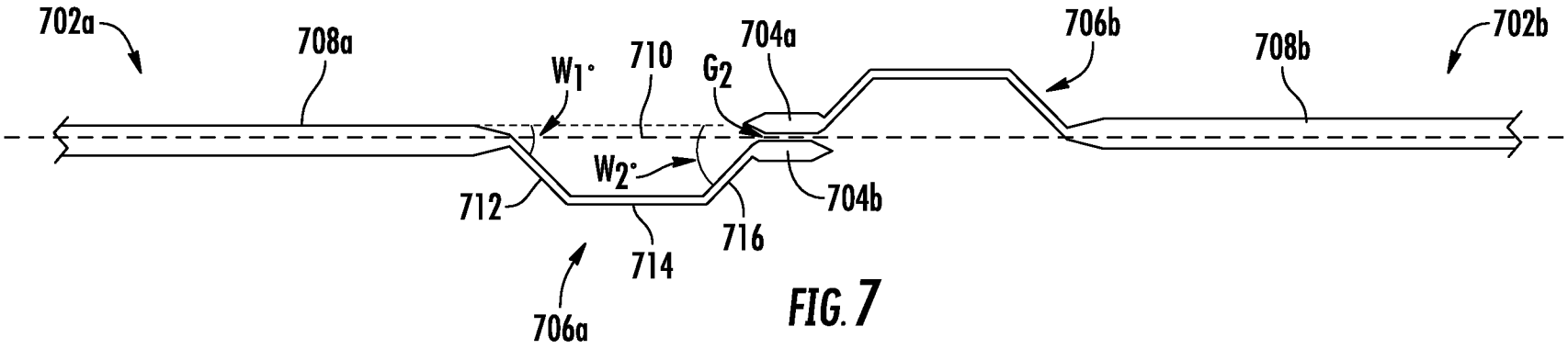
FIGS. 7 and 8 are diagrams illustrating novel reed switch blades with alternative web designs, in accordance with exemplary embodiments.
Figure 8:
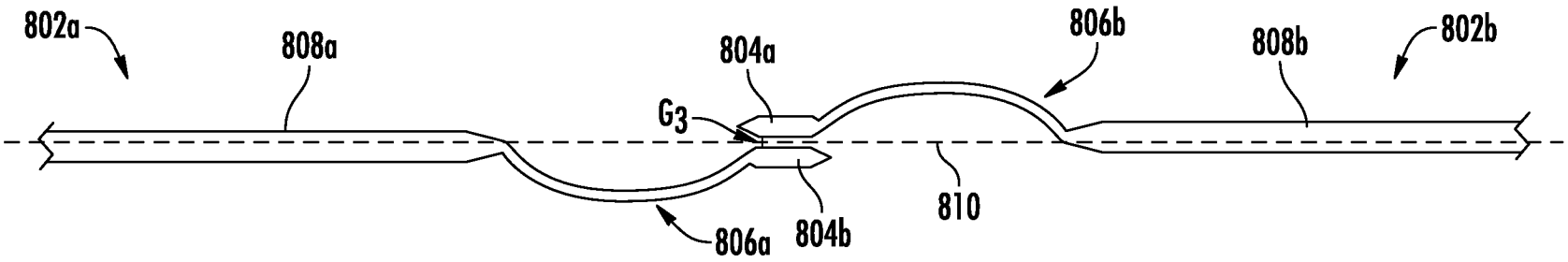

FIGS. 7 and 8 are representative drawings illustrating novel reed switch blades with alternative bend web designs, according to exemplary embodiments. FIG. 7 is a side view of blades 702*a* and 702*b* (collectively, "blades 702") that may be inserted into an enclosure of a reed switch. Blade 702*a* features contact 704*a*, web 706*a*, and lead 708*a*; blade 702*b* features contact 704*b*, web 706*b*, and lead 708*b* (collectively, "contacts 704", "webs 706", and "leads 708"). Line 710 is shown, as before, to show relative positions of each blade 702. The webs 706 are characterized as having three parts, a first section 712 that is offset from respective leads 708 by offset angle, $W_1$, a second section 714 that is parallel to the leads, and a third section 716 that is offset from respective leads by angle, $W_2$. The blade 702*b* is similarly configured.

Compared to the contacts 504 of blades 402 (FIG. 6), the contacts 704 have not changed position, relative to respective leads 708, in some embodiments. A gap, $G_2$, is maintained between contacts 704*a* and 704*b* during insertion of the blades 702 and following their sealing to respective ends of an enclosure. By changing the web 706 of each blade 702, the throwback phenomenon that characterizes the prior art blade 102 is avoided. Accordingly, in exemplary embodiments, the gap, $G_2$, is controllable using the blade design of FIG. 7 and therefore the pull-in sensitivity of a reed switch featuring the blades 702 is maintained during manufacture.

FIG. 8 is a side view of blades 802*a* and 802*b* (collectively, "blades 702") that may be inserted into an enclosure of a reed switch. Blade 802*a* features contact 804*a*, web 806*a*, and lead 808*a*; blade 802*b* features contact 804*b*, web 806*b*, and lead 808*b* (collectively, "contacts 804", "webs 806", and "leads 808"). Line 810 is shown, as before, to show relative positions of each blade 802. The webs 806 are characterized as being curved in shaped, such as in a crescent moon shape.

Compared to the contacts 504 of blades 402 (FIG. 6), the contacts 804 have not changed position, relative to respective leads 808, in some embodiments. A gap, $G_3$, is maintained between contacts 804*a* and 804*b* during insertion of the blades 802 and following their sealing to respective ends of an enclosure. By changing the web 806 of each blade 802, the throwback phenomenon that characterizes the prior art blade 102 is avoided. Accordingly, in exemplary embodiments, the gap, $G_3$, is controllable using the blade design of FIG. 8 and therefore the pull-in sensitivity of a reed switch featuring the blades 802 is maintained during manufacture.

The embodiments of FIGS. 7 and 8 are not meant to be limiting. The webs of respective blades may be adjusted in a variety of different ways to cure the throwback phenomenon during sealing of the blades to the enclosures of a reed switch. By modifying the webs to be "out of plane" from the leads of the blades, whether in the bend web design of FIG. 6 or the alternative web designs of FIGS. 7 and 8, the manufacturing deficiencies of the prior art reed switch 100 are avoided, in exemplary embodiments.

Figure 9:
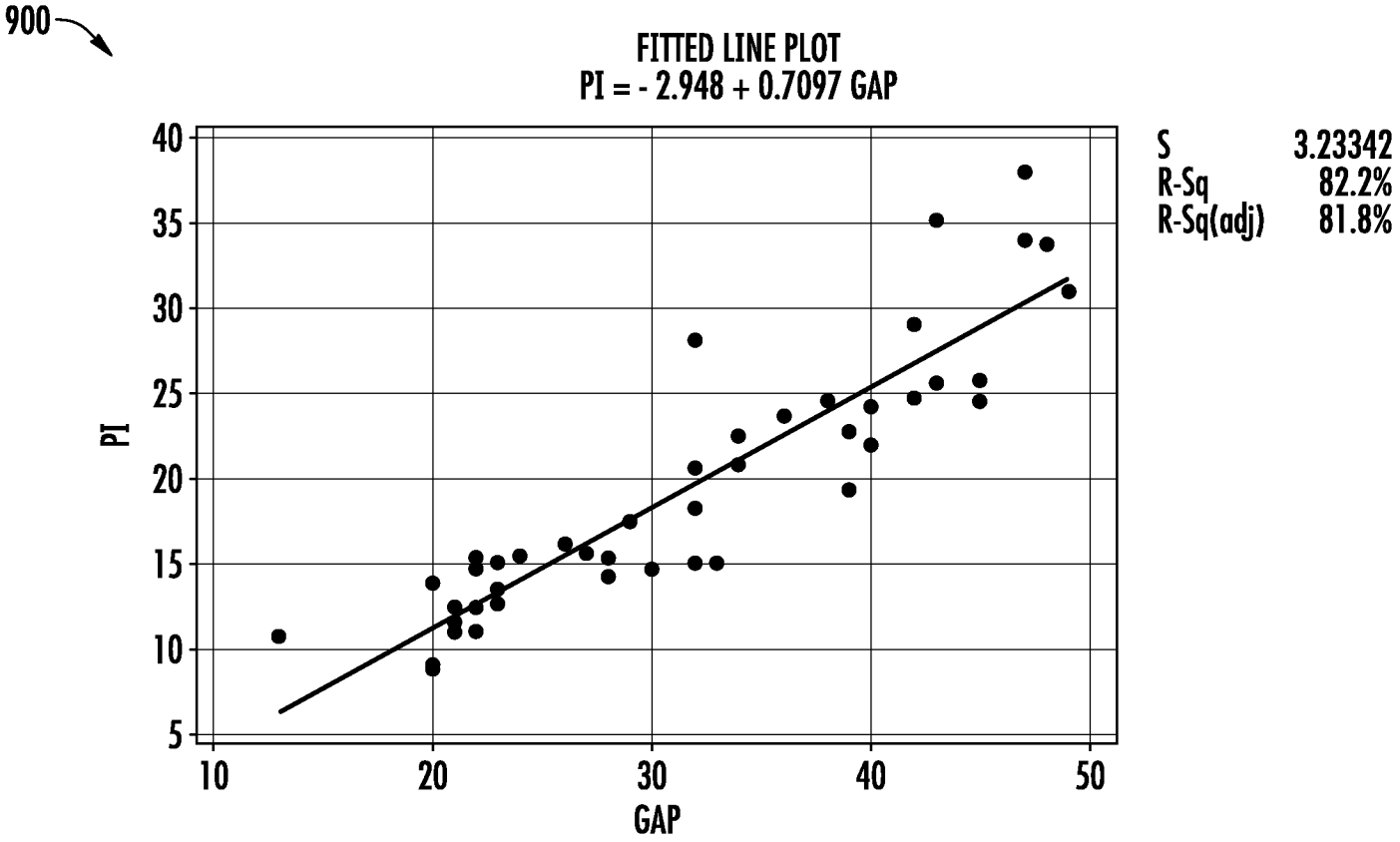
FIG. 9 is a graph illustrating a characteristic of the reed switch of FIG. 4, in accordance with exemplary embodiments.

FIG. 9 is a fitted line plot for the bend web reed switch 400 of FIG. 4, according to exemplary embodiments. The graph 900 plots the gap distance verses pull-in sensitivity of the reed switch 400. For the prior art reed switch 100 (FIG. 1A), the correlation between the pull-in sensitivity and the gap is 29% up to only 35 AT. For the novel reed switch 400, the correlation between the pull-in sensitivity and the gap is 82% for up to 50 AT, in exemplary embodiments. This means that the gap and the pull-in sensitivity are nearly linear and easier to predict. By having a consistent gap during manufacture of the reed switches, better pull-in sensitivity targeting is obtained, in some embodiments.

In exemplary embodiments, the bend web design of the novel reed switch 400 improves the targeting of pull-in sensitivity even at the range of 30 AT and above, thus ensuring the gap between blades are unaltered during glass-to-metal sealing process. Instead, for each end of the enclosure, the wire rod of the lead will be centered on the seal of the enclosure.

As used herein, an element or step recited in the singular and proceeded with the word "a" or "an" should be understood as not excluding plural elements or steps, unless such exclusion is explicitly recited. Furthermore, references to "one embodiment" of the present disclosure are not intended to be interpreted as excluding the existence of additional embodiments that also incorporate the recited features.

While the present disclosure makes reference to certain embodiments, numerous modifications, alterations and changes to the described embodiments are possible without departing from the sphere and scope of the present disclosure, as defined in the appended claim(s). Accordingly, it is intended that the present disclosure not be limited to the described embodiments, but that it has the full scope defined by the language of the following claims, and equivalents thereof.

The invention claimed is:

1. A reed switch comprising:

a cylindrical enclosure comprising a first end and a second end;

a first blade comprising a first lead, a first web, and a first contact, wherein the first web is bent at a first angle relative to the first lead and the first web is not parallel to the first lead; and a second blade comprising a second lead, a second web, and a second contact, wherein the second web is bent at a second angle relative to the second lead, and the second web is not parallel to the second lead;

wherein the first contact is adjacent to the second contact with a gap between the first contact and the second contact; and the reed switch further comprising a pull-in sensitivity, wherein a correlation between the pull-in sensitivity and the gap is 82% for up to 50 ampere-turns.

2. The reed switch of claim 1, wherein the first lead is orthogonal to the first end of the cylindrical enclosure.

3. The reed switch of claim 2, wherein the second lead is orthogonal to the second end of the cylindrical enclosure.

4. The reed switch of claim 3, wherein the gap is proportional to the pull-in sensitivity of the reed switch.

5. The reed switch of claim 1, wherein the first web, the first contact, the second web, and the second contact are hermetically sealed inside the cylindrical enclosure.

6. The reed switch of claim 1, wherein the first lead is in a plane and the second lead is in the plane.

7. The reed switch of claim 1, wherein the first angle is equal to the second angle.

8. The reed switch of claim 1, wherein the first end and the second end are heated with the first lead disposed in the first end and the second lead disposed in the second end.

9. A reed switch, comprising:

a first blade to be inserted into a first end of a cylindrical enclosure, the first blade comprising:

a first external portion comprising a first portion of a first lead; and a first internal portion comprising a second portion of the first lead, a first web, and a first contact, wherein the first web is bent at a first angle relative to the second portion of the first lead and the first web is not parallel to the second portion of the first lead; and a second blade to be inserted into a second end of the cylindrical enclosure, the second blade comprising:

a second external portion comprising a third portion of a second lead; and a second internal portion comprising a fourth portion of the second lead, a second web, and a second contact, the second contact being adjacent to and at predetermined distance from the first contact, wherein the second web is bent at a second angle relative to the fourth portion of the second lead and the second web is not parallel to the fourth portion of the second lead; and the reed switch further comprising a pull-in sensitivity, wherein a correlation between the pull-in sensitivity and the gap is 82% for up to 50 ampere-turns.

10. The reed switch of claim 9, wherein the first lead is in a plane and the second lead is in the plane.

11. The reed switch of claim 10, wherein the first end and the second end are bisected by the plane.

12. The reed switch of claim 9, wherein the first lead is orthogonal to the first end and the second lead is orthogonal to the second end.

13. The reed switch of claim 9, wherein the predetermined distance is proportional to a pull-in sensitivity of the reed switch.

14. The reed switch of claim 9, wherein the first angle is equal to the second angle.

15. A method of manufacturing a reed switch, comprising:

inserting a first blade into a first end of a glass enclosure, the first blade comprising a first lead, a first web, and a first contact, the first web being bent and not parallel relative to the first lead, wherein the first web and the first contact are inside the glass enclosure and the first lead crosses a threshold of the first end;

heating the first end to seal the first blade in the first end, wherein the first blade is orthogonal to the first end once the first end cools and hardens;

inserting a second blade into a second end of the glass enclosure, the second blade comprising a second lead, a second web, and a second contact, the second web being bent and not parallel relative to the second lead and the second contact being adjacent to the first contact with a gap therebetween, wherein the second web and the second contact are inside the glass enclosure and the second lead crosses a second threshold of the second end; and heating the second end to seal the second blade in the second end, wherein the gap does not change once the second end cools and hardens;

wherein the reed switch comprises a pull-in sensitivity, wherein the pull-in sensitivity has a correlation to the gap, wherein the correlation is 82% for up to 50 ampere-turns.

16. The method of claim 15, wherein the second blade is orthogonal to the second end once the second end cools and hardens.

17. The method of claim 15, wherein the first web, the first contact, the second web, and the second contact are hermetically sealed inside the glass enclosure.

* * * * *